US006755679B2

(12) United States Patent
Godefroy et al.

(10) Patent No.: US 6,755,679 B2
(45) Date of Patent: Jun. 29, 2004

(54) DEVICE FOR MAINTAINING SEATING ZONES OF A FLEXIBLE CIRCUIT IN AN ELECTRICAL CONNECTOR, AND CONNECTOR SO EQUIPPED

(75) Inventors: Alban Godefroy, Epernon (FR); Claude Casses, Clevilliers (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/381,998

(22) PCT Filed: Oct. 2, 2001

(86) PCT No.: PCT/EP01/11415

§ 371 (c)(1),
(2), (4) Date: Jun. 27, 2003

(87) PCT Pub. No.: WO02/29933

PCT Pub. Date: Apr. 11, 2002

(65) Prior Publication Data

US 2004/0043655 A1 Mar. 4, 2004

(30) Foreign Application Priority Data

Oct. 2, 2000 (FR) ..... 00 12540

(51) Int. Cl.[7] ..... H01R 11/20

(52) U.S. Cl. ..... 439/422; 439/492; 439/467; 439/499

(58) Field of Search ..... 439/422, 492, 439/499, 467, 494

(56) References Cited

U.S. PATENT DOCUMENTS

| | | | | | |
|---|---|---|---|---|---|
| 3,336,565 | A | * | 8/1967 | Crimmins | 439/459 |
| 3,641,482 | A | * | 2/1972 | Bretting | 439/499 |
| 3,989,336 | A | * | 11/1976 | Rizzio et al. | 439/260 |
| 4,068,912 | A | * | 1/1978 | Hudson et al. | 439/405 |
| 4,082,402 | A | * | 4/1978 | Kinkaid et al. | 439/422 |
| 4,194,803 | A | | 3/1980 | Hatch | 339/99 R |
| 4,427,303 | A | | 1/1984 | Matthias | 368/282 |
| 5,516,984 | A | | 5/1996 | Soes et al. | 174/65 R |
| 6,464,532 | B1 | * | 10/2002 | L'Abbate et al. | 439/467 |

FOREIGN PATENT DOCUMENTS

| | | | |
|---|---|---|---|
| JP | 3-98270 | * | 4/1991 |
| JP | 6-188047 | * | 7/1994 |
| NL | 7 508 226 A | | 12/1977 |

* cited by examiner

*Primary Examiner*—Tho D. Ta
(74) *Attorney, Agent, or Firm*—Harrington & Smith, LLP

(57) ABSTRACT

The abject of the invention is a device for maintaining crimping regions of a flexible circuit in an electrical connector comprising a body (12) provided on the one hand with housings (14) adapted to receive contacts (16) with pins (24,25) to be crimped, and on the other hand with a flap (28) that is moveable in rotation with respect to this body about an axis (30).

Figure 1:
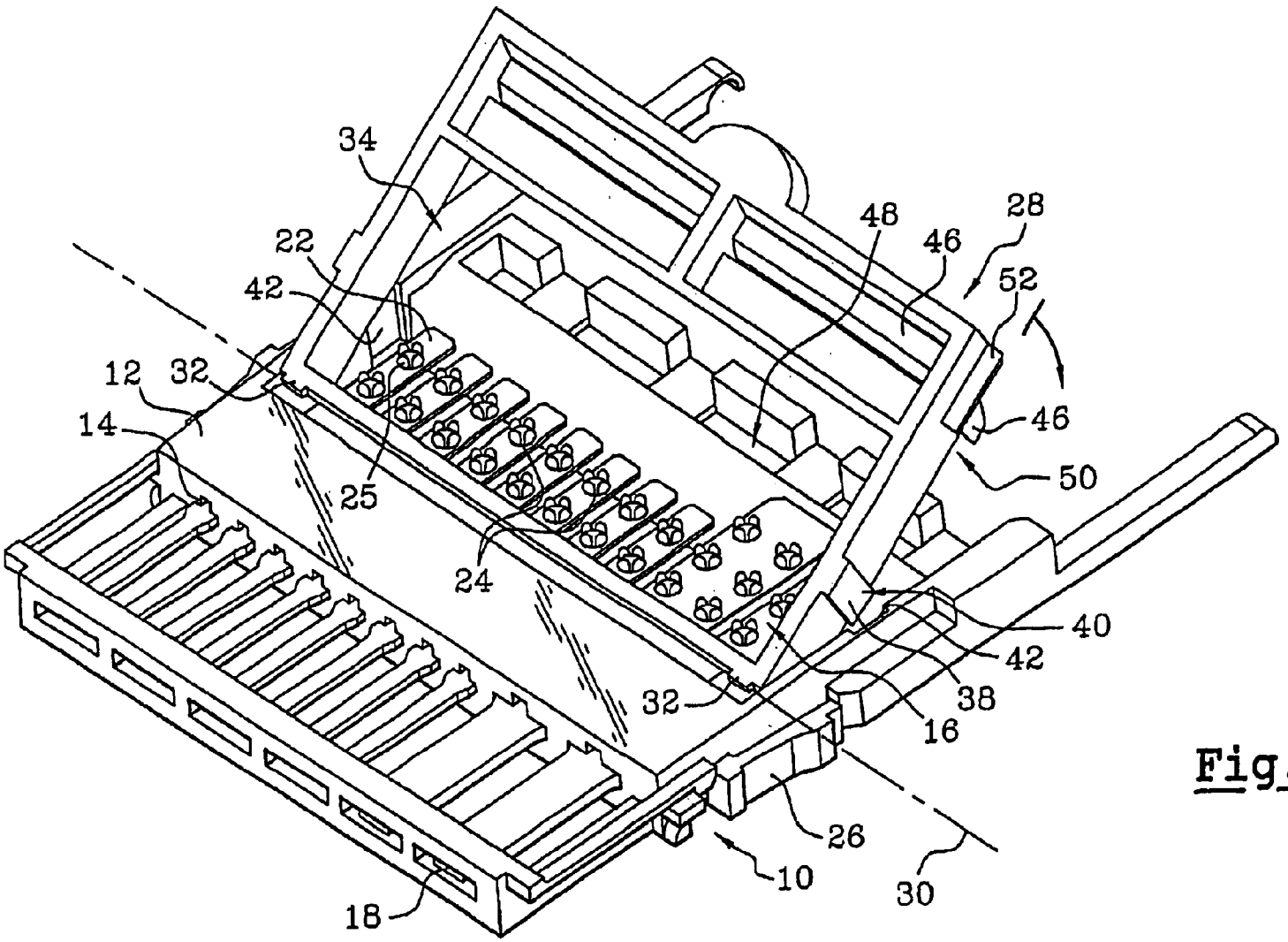

The invention also covers the connector equipped with this device.

7 Claims, 5 Drawing Sheets

DEVICE FOR MAINTAINING SEATING ZONES OF A FLEXIBLE CIRCUIT IN AN ELECTRICAL CONNECTOR, AND CONNECTOR SO EQUIPPED

The present invention concerns a device for maintaining seating zones of a flexible circuit in an electrical connector. The invention also covers the electrical connector thus equipped with this maintaining device.

The flexible circuits in question, more generally designated as "flex" in the field of connectors, are sheets formed from a first layer of insulating material on which are built up wiring lines of conductive material which constitute both conductors and contacts.

These wiring lines are protected and insulated by a second layer of insulating material or by a dielectric varnish.

Such flexible circuits are used in the case of multiple contacts to be disposed in a small clearance and to be rejoined at their outlet as they were at their inlet.

The width and thickness of the wiring lines determines the conductive capacity, which in turn leads to disposing, on a same flexible circuit and in a same connector, varying dimensions of contacts.

The numerous advantages of these flexible circuits have led to designers using them more and more, especially in the automotive field.

In practice, the connection of the set of contacts is effected in a single operation, generally by seating after introduction of the flexible circuit into the connector. Generally, locking means assure in a complementary manner the mechanical retention of the sheet in the said connector.

Connection devices for flexible circuits are known, in particular from French patent application No. 99/13772 now published under FR 2 800 520 A1 in the name of the same applicant, which illustrates this type of connector and this mode of connection.

To that end, the connector described in this prior art comprises a casing provided with a series of cavities for receiving contacts with terminals to be seated on the flexible circuit, and a cover element constituted of a frame provided with an opening permitting the passage of a seating tool.

Thus, the casing is present with its cover opened to permit the introduction of the contacts, then this element is closed, leaving a passage slit for inserting the flexible circuit, which immediately arrives above the contacts to be seated. The seating is done by crimping the contacts by means of a crimping tool and permits seating various contacts on the circuit.

This cover element is also provided with foldable tabs, integral with the supporting frame of the pins. Simultaneously with crimping, these tabs are folded and the pins penetrate into holes previously provided in the flexible circuit.

The pins, after passing through these holes of the flexible circuit, are retained in corresponding housings of the casing.

Although this arrangement is satisfactory from the viewpoint of contact quality, as well as mechanical resistance to detachment and reliability, there remains a difficulty in that the manufacturing is delicate in the sense that the circuits must be pre-formed with holes.

Moreover, the mechanical retention is effected only at two or three points corresponding to the holes, and could be improved.

Finally, the formation of holes requires positioning them in the circuit between the wiring lines, to the detriment of compactness.

The present invention seeks to further improve this arrangement, so as to provide a connector wherein the device for maintaining crimping zones is complete, with distributed and linear forces. Moreover, the present device, a detailed description of which will follow, is especially advantageous in the sense that it avoids any manipulation of the flexible circuit for forming holes therein, as it is, on the contrary, mounted "as is."

The manufacture of the connector itself is facilitated and the mounting of the flexible circuits is also greatly simplified.

According to the present invention, the device for maintaining crimping seating zones of a flexible circuit in an electrical connector comprises a body provided on the one hand with housings adapted to receive contacts with pins to be crimped, and, on the other hand, with a flap that is moveable in rotation with respect to this body about an axis, characterized in that it comprises means for clamping the flexible circuit in the body comprising an opposed tongue and groove pair, disposed parallel to the axis of rotation of the flap.

According to a preferred embodiment, the tongue has a trapezoidal section, so as to constitute with the groove an open U-shaped offset portion.

The retaining solution consists of disposing the tongue on the flap and providing the groove in the body.

The invention also covers the electrical connector equipped with this device for maintaining crimping zones of a flexible circuit and it moreover comprises locking means for the flap when the tongue cooperates with the groove, after the flexible circuit has been positioned.

According to another characteristic, the flap is formed by molding with the body and may assume three principal positions:

- an as-molded open position, with an angle of about 75°,
- a delivery position permitting the insertion of the contacts and the insertion of the flexible circuit, with an angle comprised between 20° and 5° , and
- a closure position, with no angle, upon crimping of the flexible circuit.

Figure 2:
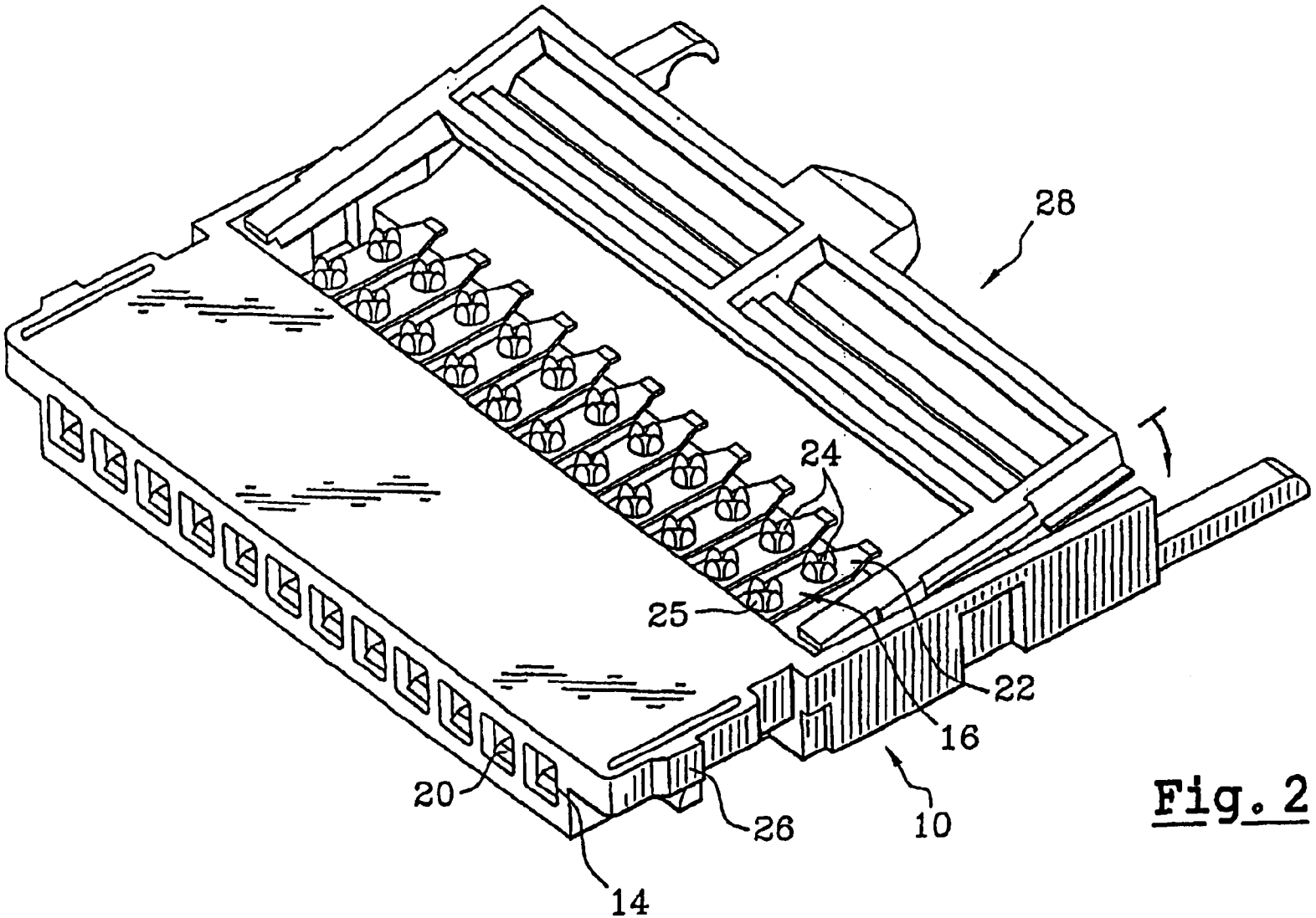
Figure 3A:
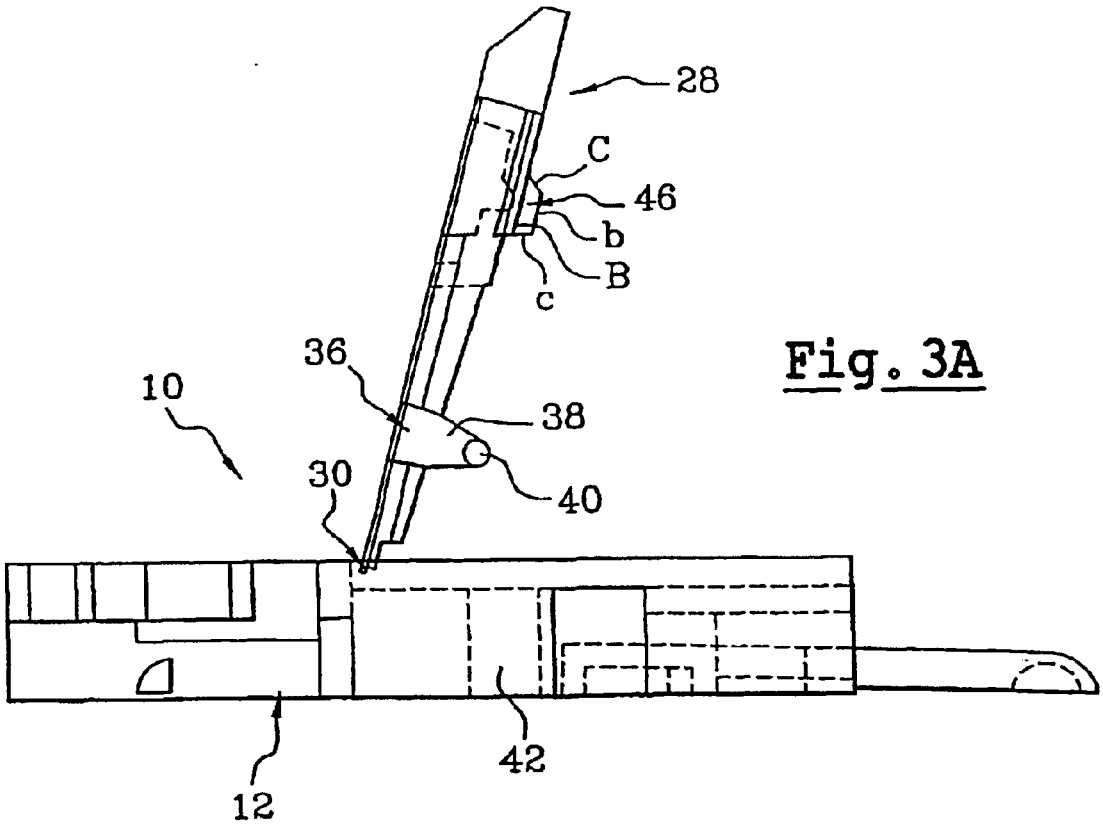
Figure 3B:
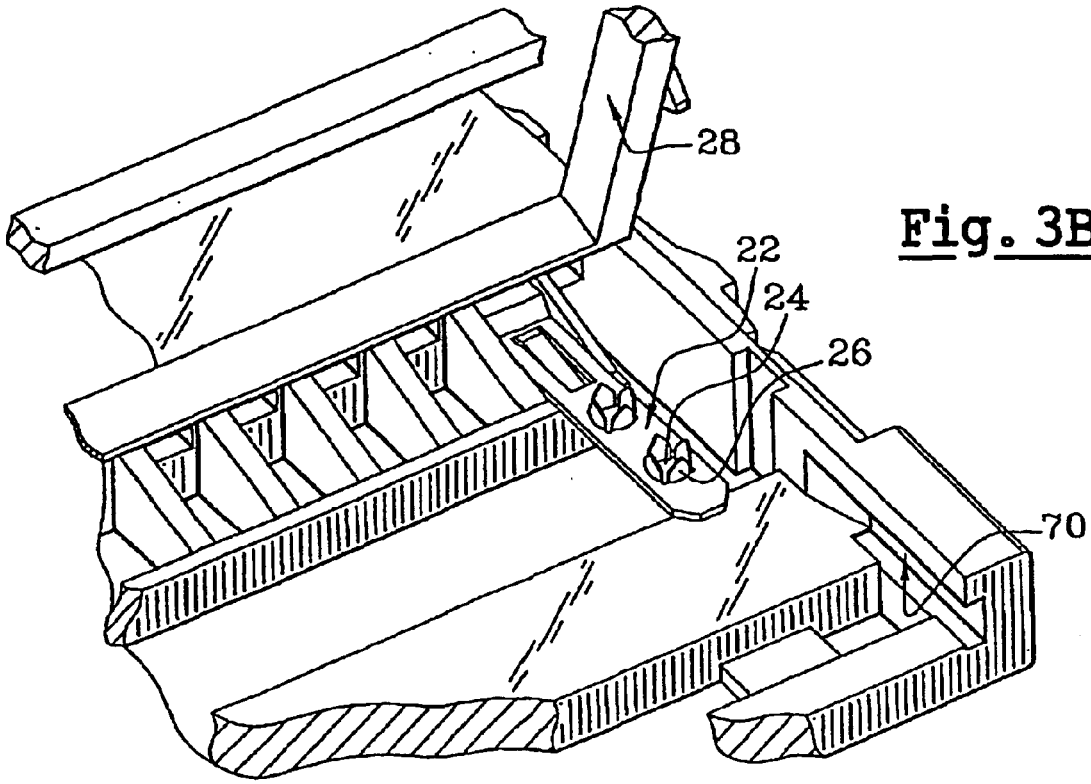
Figure 3C:
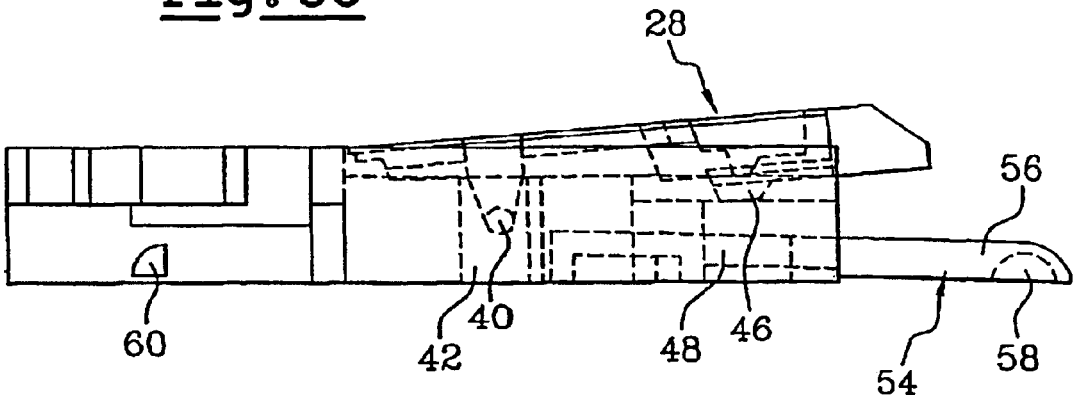
Figure 3D:
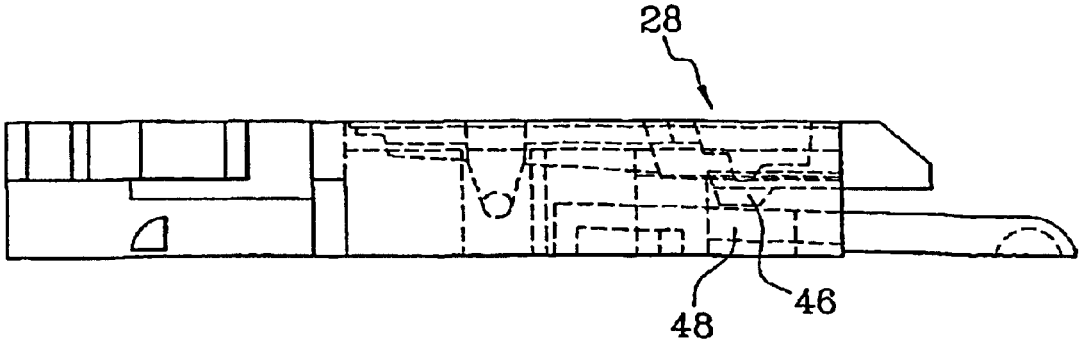
Figure 4A:
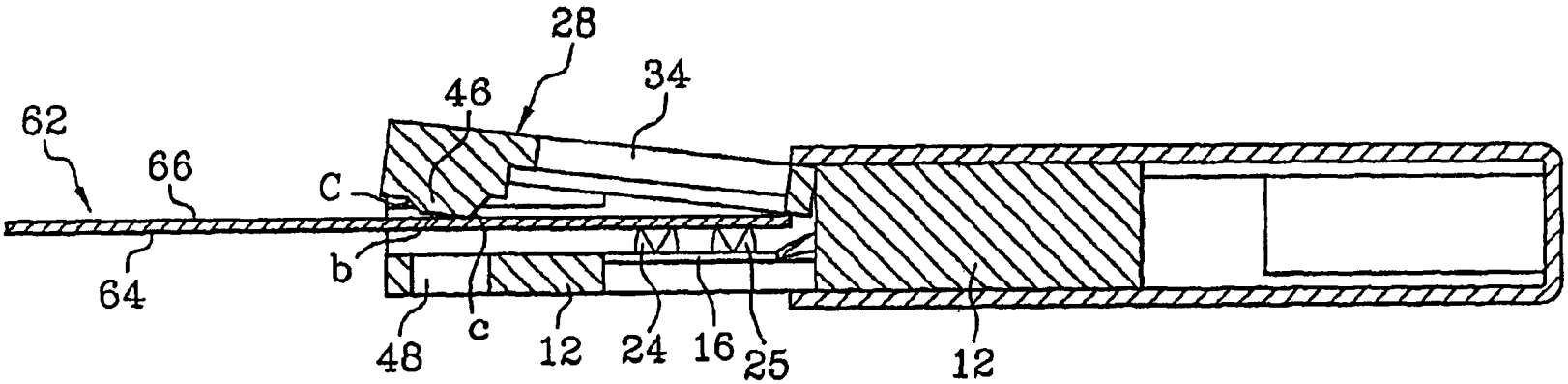
Figure 4B:
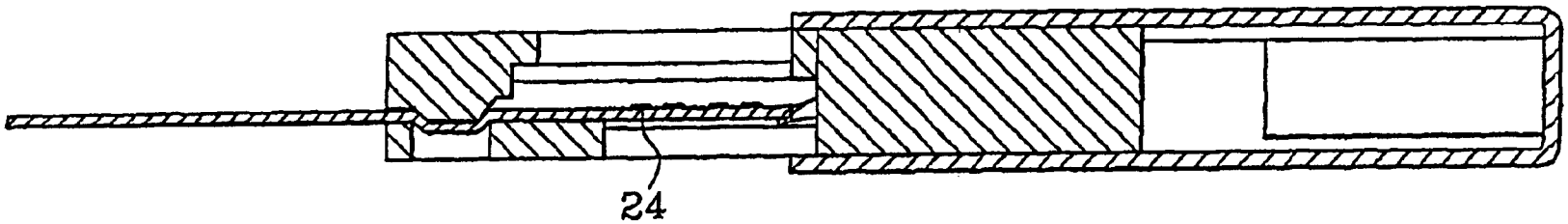

So as to illustrate this arrangement, a preferred but non-limiting embodiment is now described in detail and with reference to the accompanying drawings, which show in the various figures:

FIG. 1, a perspective view of a male contact-carrying module in delivery position with its flap open, FIG. 2, a perspective view of a female contact-carrying module, with its flap in the pre-insertion position for the flexible circuit, immediately before mounting, FIG. 3A, a side elevational view of the contact-carrying module of FIG. 2, after manufacture by molding, FIG. 3B, a perspective view showing details of the rear of the module, FIG. 3C, a side elevational view of the same contact-carrying module, the flap having a limited degree of opening corresponding to the delivery position, FIG. 3D, a side elevational view of the same contact-carrying module as that of FIG. 3B, but upon closing and locking the flap, after crimping of the contacts, FIGS. 4A and 4B, sectional views showing the positions of the flexible circuit with respect to the contacts before and after mounting and seating of this flexible circuit on these contacts, the module being pre-inserted into a module-carrier.

In FIG. 1, the contact-carrying module 10 comprises a body 12 formed by molding and adapted to be introduced into a connector having a matching profile.

This body comprises a succession of juxtaposed housings 14 adapted to receive electrical contacts 16 of the same dimensions or of varying dimensions, as shown.

Such contacts are male pin contacts 18, shown in FIG. 1, or female cage contacts 20, as shown in FIG. 2. In both cases, the rear portion of these contacts has the shape of a blade 22 provided with cutouts 24 with pins 25 to be seated and/or crimped.

In a known manner, the means for introducing and retaining provided on these contacts permit their positioning and immobilization in these housings.

In the same manner, the body 12 carries snap locking means 26 for connecting with the connector of matching profile, into which it will be received.

This contact-carrying module comprises a flap 28, which is mounted for rotation about an axis 30. This flap is advantageously molded with the body, the connection being effected by two flexible strips 32.

This flap comprises a window 34 which opens above the blades 22 provided with their crimping pins 25. This window is adapted to allow the passage of a crimping tool, not shown. Such a tool is well known and is present in the form of a striker provided with specially-shaped housings for causing the crimping seating of the pins 25 as a function of the pin type.

Laterally, this flap is equipped with snap locking means 36 composed of a pair of tabs 38 each bearing a projection 40, adapted to cooperate with a pair of facing openings 42 arranged in the body 12.

This flap is moreover equipped with means 44 for restraining the flexible circuit to be introduced, whose positioning will be described hereinbelow.

These restraining means 44 are described not only with respect to FIGS. 1 and 2, but also the series of FIGS. 3 and 4.

These restraining means comprise a projecting tongue 46 carried by the flap, formed by molding and having a substantially inverted right trapezoidal section. Specifically, the small base b is oriented downwardly, and the large base B is the interface with the flap itself.

The more inclined side C is oriented rearwardly of the body of the module, whereas the less inclined side c is oriented forwardly, that is to say toward the window 34.

This tongue 46 extends parallel to the axis of rotation 30 throughout the width of this flap.

In facing relation, the body 12 is provided with a groove 48 having a complementary profile, adapted to receive this tongue. More particularly, the groove is adapted to receive the small base b, which is in facing relation thereto. The dimensions of this groove are less than those of the tongue, such that the inclined transverse sides may come into contact on the angles of the opening of the groove, while allowing only a portion of the tongue to penetrate via its small base b. These dimensional details are particularly visible in FIGS. 4A and 4B.

Additionally, the flap is equipped with locking means 50 in the closed position. These means comprise two lateral assemblies each composed of an edge catch 52 adapted to snap into a groove 70 of corresponding profile, visible in FIG. 3B.

Moreover, the module 10 and/or module-carrier 120 comprises means 54 for interconnecting in series. These series interconnecting means permit joining the modules and/or modules and module-carriers to one another as molded, for automatic mounting.

Such means 54 are constituted on the one hand of an arm 56 disposed at the rear of the body of the module-carrier, which arms are each equipped at their end with a blind opening 58 and on the other hand with element 60 also integral with the body 12, each element having a profile adapted to the blind opening 58.

Each catch/arm pair forms a hinge after snapping together, permitting a pivoting motion.

The device for maintaining the contacts of a carrier-module such as described above, is operated in the following manner.

FIGS. 3A to 3D and 4A and 4B will be primarily referred to.

The flexible circuit is referenced 62, with an underlying insulating layer 64 and conductive wiring lines 66 built up thereon, the insulating varnish deposited on the surface not being shown for purposes of clarity.

The module as molded, as shown in FIG. 3A, has the flap opened at 75°, that is to say very wide open for reasons related to the manufacture.

This flap is lowered so as to place it in delivery position as shown in FIG. 3B, the angle of opening being decreased to 20°. This angular position permits introduction of the contacts into the housings 14 provided for that purpose. The maintenance of this standby position is assured by the projection 40, which cooperates with the opening 42.

The flap may go down to an angular position of 5°, but tends to stay in place owing to its elasticity. In this position, the tongue 46 is above the groove 48 but, as is visible in FIG. 4A, the gap which remains permits the introduction of the flexible circuit above the crimping pins 25 of the cutouts 24 of the contacts 16.

The locking means 50 are not in position and the edge catch 52 is bearing on the side edges of the body 12, which prevents inadvertent closure and locking from only a slight force.

After the crimping tool is actuated to crimp the pins, the flap 28 is completely closed. In this position, the flexible circuit has been perforated by the pins 25, which are crimped seated on the wiring lines 66.

The locking means 50, catches 52 and grooves 70, retain the flap in this position.

With respect to the flexible circuit, the sheet undergoes a deformation in the shape of an opened U, as it passes between the tongue 46 and the groove 48. This offset assures a fixing and a maintaining of this sheet in the mounted position, and prevents displacement of the sheet relative to the carrier-module, even in the case of a pulling force exerted on the flexible circuit, either during operation or, for example, during disassembly.

The flexible circuit is thus securely maintained and the crimping on the pins 25 should not in and of itself take up all of the mechanical forces.

It will be noted that this offset portion does not damage the flexible circuit and above all does not affect the integrity of the wiring lines, as the four regions of folding occur over relatively large angles; which prevents any risk of fracture.

Moreover, the connection is reinforced by the fact that the tongue/groove combination acts transversely over the entire width, which permits effecting a deformation of the flexible circuit over all of its width, such that any possible exerted pulling force is thus distributed.

In this embodiment, the restraining means are arranged such that the tongue is carried by the flap and the groove is arranged in the body, but this pair may be disposed in the reverse manner without departing from the spirit of the invention.

What is claimed is:

1. Device for maintaining crimping zones of a flexible circuit (62) in an electrical connector comprising a body (12)

provided with housings (14) adapted to receive contacts (16) with pine (24, 25) to be crimped and a flap (28) moveable in rotation with respect to this body about an axis (30), characterized in that the body and the flap comprise a tongue (46)/groove C48) combination, in facing relation, disposed parallel to the axis of rotation (30) of the flap for restraining the flexible circuit (62) in the body (12), wherein the flap (28) comprises an access window (34) for the pins (24, 25) to be crimped.

2. Maintaining device according to claim 1, characterized in that the tongue (46) is carried by the flap (28) and the groove (48) is arranged in the body (12).

3. Electrical connector equipped with the device for maintaining crimping zones of a flexible circuit according to claim 1, characterized in that it comprises means (50, 52, 70) for locking the flap (28) when the tongue (46) cooperates with the groove (48), after the flexible circuit (62) is positioned.

4. Maintaining device according to claim 1, characterized in that the tongue (46) has a trapezoidal section so as to constitute with the groove (48) an open U-shaped offset portion.

5. Maintaining device according to claim 4, characterized in that the tongue (46) has a substantially trapezoidal section with a small base b oriented toward the groove, the large base B (B) toward the flap, the more inclined side (C) inclined rearwardly of the body and the less inclined side (c) oriented forwardly.

6. Electrical connector equipped with a device for maintaining crimping zones of a flexible circuit in an electrical connector comprising a body provided with housings adapted to receive contacts with pins to be crimped and with a flap moveable in rotation with respect to the body about an axis, wherein the body and the flat comprise a restraint for restraining the flexible circuit in the body comprising a tongue/groove combination, in facing relation, disposed parallel to the axis of rotation of the flap, wherein the body comprises a lock for locking the flap when the tongue cooperates with the groove, after the flexible circuit is positioned, characterized in that the flap comprises a pair of tabs each bearing a projection, adapted to cooperate with a pair of openings disposed in facing relation, arranged in the body, so as to maintain the flap in a standby position.

7. Electrical connector equipped with a device for maintaining crimping zones of a flexible circuit in an electrical connector comprising a body provided with housings adapted to receive contacts with pine to be crimped and with a flap moveable in rotation with respect to the body about an axis, wherein the body and the flat comprise a restraint for restraining the flexible circuit in the body comprising a tongue/groove combination, in facing relation, disposed parallel to the axis of rotation of the flap, wherein the body comprises a lock for locking the flap when the tongue cooperates with the groove, after the flexible circuit is positioned, characterized in that the flap is molded with the body and may assume three principal positions:

an open as-molded position with an angle of about 75°, a delivery position with an anile between 20° and 5°, permitting insertion of the contacts and insertion of the flexible circuit, and a closure position upon crimping of the flexible circuit, with no angle.

* * * * *

UNITED STATES PATENT AND TRADEMARK OFFICE

CERTIFICATE OF CORRECTION

PATENT NO. : 6,755,679 B2
DATED : June 29, 2004
INVENTOR(S) : Alban Godefroy et al.

It is certified that error appears in the above-identified patent and that said Letters Patent is hereby corrected as shown below:

Column 5,
Line 2, delete “pine” and replace with -- pins --.
Line 5, delete “C48)” and replace with -- (48) --.
Line 26, delete “B”.

Column 6,
Line 15, delete “pine” and replace with -- pins --.
Line 27, delete “anile” and replace with -- angle --.

Signed and Sealed this

Twenty-first day of December, 2004

JON W. DUDAS
*Director of the United States Patent and Trademark Office*